US007753474B2

(12) United States Patent
Hiruma et al.

(10) Patent No.: US 7,753,474 B2
(45) Date of Patent: Jul. 13, 2010

(54) DROPLET EJECTION APPARATUS, METHOD FOR RECOVERING DROPLET EJECTION HEAD, METHOD FOR FORMING THIN FILM, AND LIQUID CRYSTAL DISPLAY

(75) Inventors: Kei Hiruma, Chino (JP); Takahiro Ushiyama, Chino (JP)

(73) Assignee: Seiko Epson Corporation (JP)

( * ) Notice: Subject to any disclaimer, the term of this patent is extended or adjusted under 35 U.S.C. 154(b) by 678 days.

(21) Appl. No.: 11/708,120

(22) Filed: Feb. 16, 2007

(65) Prior Publication Data

US 2007/0195122 A1 Aug. 23, 2007

(30) Foreign Application Priority Data

Feb. 17, 2006 (JP) ..... 2006-040492
Jan. 12, 2007 (JP) ..... 2007-004799

(51) Int. Cl.
*B41J 2/165* (2006.01)

(52) U.S. Cl. ..... 347/29; 347/23; 347/32

(58) Field of Classification Search ..... 347/29, 347/30, 32, 23, 28, 95
See application file for complete search history.

(56) References Cited

U.S. PATENT DOCUMENTS 5,412,411 A 5/1995 Anderson
2005/0271832 A1 12/2005 Goto

FOREIGN PATENT DOCUMENTS

| | | | |
|---|---|---|---|
| CN | 1693971 | | 11/2005 |
| JP | 01-148557 | | 6/1989 |
| JP | 07-195701 | | 8/1995 |
| JP | 08-318623 | | 12/1996 |
| JP | 2001-138540 | * | 5/2001 |
| JP | 2002-187288 | | 7/2002 |
| JP | 2003-001839 | | 1/2003 |
| JP | 2003-127400 | | 5/2003 |
| JP | 2003-266719 | | 9/2003 |
| JP | 2004-050059 | | 2/2004 |

* cited by examiner

*Primary Examiner*—Shih-Wen Hsieh
(74) *Attorney, Agent, or Firm*—Harness, Dickey & Pierce, P.L.C.

(57) ABSTRACT

A droplet ejection apparatus having a droplet ejection head, a cap casing, a pump, and a movement device is disclosed. The droplet ejection head ejects liquefied material containing functional material from nozzles as droplets. The cap casing has an accommodating portion in which a portion of the droplet ejection head including at least the nozzle forming surface is accommodated. The pump supplies liquid to the accommodating portion. The movement device moves at least one of the cap casing and the droplet ejection head relative with the other. When recovery is performed on the droplet ejection head or the droplet ejection head is held in a nonoperating state, the movement device arranges the cap casing relative to the droplet ejection head in such a manner that the nozzle forming surface is immersed in the liquid retained in the accommodating portion.

12 Claims, 8 Drawing Sheets

DROPLET EJECTION APPARATUS, METHOD FOR RECOVERING DROPLET EJECTION HEAD, METHOD FOR FORMING THIN FILM, AND LIQUID CRYSTAL DISPLAY

CROSS-REFERENCE TO RELATED APPLICATIONS

This application is based upon and claims the benefit of priority from prior Japanese Patent Application No. 2006-040492, filed on Feb. 17, 2006 and Japanese Patent Application No. 2007-004799, filed on Jan. 12, 2007, the entire contents of which are incorporated herein by reference.

BACKGROUND

The present invention relates to a droplet ejection apparatus having a droplet ejection head, a method for recovering a droplet ejection head, a method for forming a thin film using a droplet ejection apparatus, and a liquid crystal display.

As a droplet ejection apparatus having a droplet ejection head, an inkjet type recording apparatus that ejects ink, which is liquefied material, from an inkjet head onto a recording paper sheet is known.

The recording apparatus can have printing problems if the ink dries in nozzles of the inkjet head, causing nozzle clogging or offset ejection of the ink. Therefore, to stabilize image quality provided by the apparatus, the dry ink is removed from nozzles of a nozzle forming surface of the inkjet head by drawing the ink from the nozzles, with a cap, or a sealing member, held in tight contact with the nozzle forming surface. Also, the nozzle forming surface is wiped by a wiping member to remove the ink or foreign matter from the nozzle forming surface. Such operations are referred to as recovery, refreshment, or cleaning of the inkjet head.

JP-A-2003-127400 discloses a cap having a retainer portion provided in a bottom portion of a cap casing. The retainer portion retains liquid that generates vapor. When the recording apparatus is in a nonoperating state, the cap casing is maintained in tight contact with a nozzle forming surface. This prevents dryness of the ink in nozzles and the vicinity of the nozzles.

JP-A-2003-001839 discloses an apparatus that performs recovery of an inkjet head by pressing a rigid cap against an elastic seal material, which is arranged in an inkjet head in such a manner as to encompass a nozzle forming surface. Through such pressing of the cap against the seal member, the nozzle forming surface is sealed with improved air-tightness.

As described in JP-A-2003-127400, the cap is formed of semi-rigid synthetic rubber. Likewise, as described in JP-A-2003-001839, the elastic seal member, which is held in contact with the rigid cap, is formed of rubber or the like. Therefore, if the ink adheres to the cap or the seal member formed of rubber, the cap or the seal member may deteriorate, which lowers sealing performance of the cap or the seal member. Further, such deterioration may separate a portion from the cap or the seal member, causing the portion to adhere to the nozzle forming surface.

Further, a droplet ejection method for forming a thin film on a surface of a workpiece by ejecting, instead of ink, liquefied material containing functional material from a droplet ejection head onto the workpiece now draws attention. The liquefied material contains a specific solvent selected in correspondence with the functional material. If capping devices described in the aforementioned documents are employed in the droplet ejection head that ejects the liquefied material containing the functional material, deterioration of the cap or the elastic seal member, which are formed of rubber, becomes increasingly significant depending on properties of the solvent.

Further, when the nozzle forming surface is sealed by the cap, the nozzle forming surface is exposed to the air in the sealed space defined by the cap. In this state, the liquefied material in the nozzles becomes progressively dry. Therefore, if the nozzle forming surface is maintained in a state sealed by the cap for an excessively long time, nozzle clogging or offset ejection of the ink can occur.

SUMMARY

Accordingly, it is an objective of the present invention to effectively prevent nozzle clogging and offset ejection of ink.

To achieve the foregoing objective, in accordance with a first aspect of the present invention, a droplet ejection apparatus including a droplet ejection head, a cap casing, a liquid supply device, and a movement device is provided. The droplet ejection head has a nozzle forming surface in which a nozzle is formed. The droplet ejection head ejects a liquefied material containing a functional material from the nozzle as a droplet. The cap casing has an accommodating portion in which a portion of the droplet ejection head including at least the nozzle forming surface is accommodated. The liquid supply device supplies a liquid to the accommodating portion. The movement device moves at least one of the cap casing and the droplet ejection head relative with the other. When recovery is performed on the droplet ejection head or the droplet ejection head is held in a nonoperating state, the movement device arranges the cap casing relative to the droplet ejection head in such a manner that the nozzle forming surface is immersed in the liquid retained in the accommodating portion.

In accordance with a second aspect of the present invention, the liquefied material used in the first aspect is a liquefied material containing an alignment film forming material. In this case, the droplet ejection apparatus is an alignment film forming apparatus that ejects the liquefied material containing the alignment film forming material onto a workpiece as droplets for forming an alignment film on the workpiece.

In accordance with a third aspect of the present invention, a liquid crystal display having an alignment film formed by the droplet ejection apparatus according to the second aspect is provided.

In accordance with a fourth aspect of the present invention, a method for recovering a droplet ejection head that ejects a liquefied material containing a functional material from a nozzle as a droplet is provided. The method includes: retaining a liquid that is the same as at least one type of solvent contained in the liquefied material in an accommodating portion of a cap casing; and immersing a nozzle forming surface in the liquid in the accommodating portion by receiving a portion of the droplet ejection head including at least the nozzle forming surface in the accommodating portion.

In accordance with a fifth aspect of the present invention, a method for forming a thin film of a functional material on a workpiece using a droplet ejection head that ejects a liquefied material containing the functional material from nozzles as droplets is provided. The method includes: retaining a liquid that is the same as at least one type of solvent contained in the liquefied material in an accommodating portion of a cap casing; immersing a nozzle forming surface in the liquid in the accommodating portion by receiving a portion of the droplet ejection head including at least the nozzle forming surface in the accommodating portion; substantially sealing the nozzle forming surface by the cap casing after the immersing; drawing the liquefied material from the interior of the droplet ejection head through the nozzle with the nozzle forming surface sealed by the cap casing; ejecting the liquefied material as droplets onto the workpiece from the nozzles after the drawing the liquefied material; and drying the droplets on the workpiece, thereby forming a thin film made of the functional material on the workpiece.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

A first embodiment of the present invention will now be described with reference to FIGS. 1 to 3B.

Figure 1:
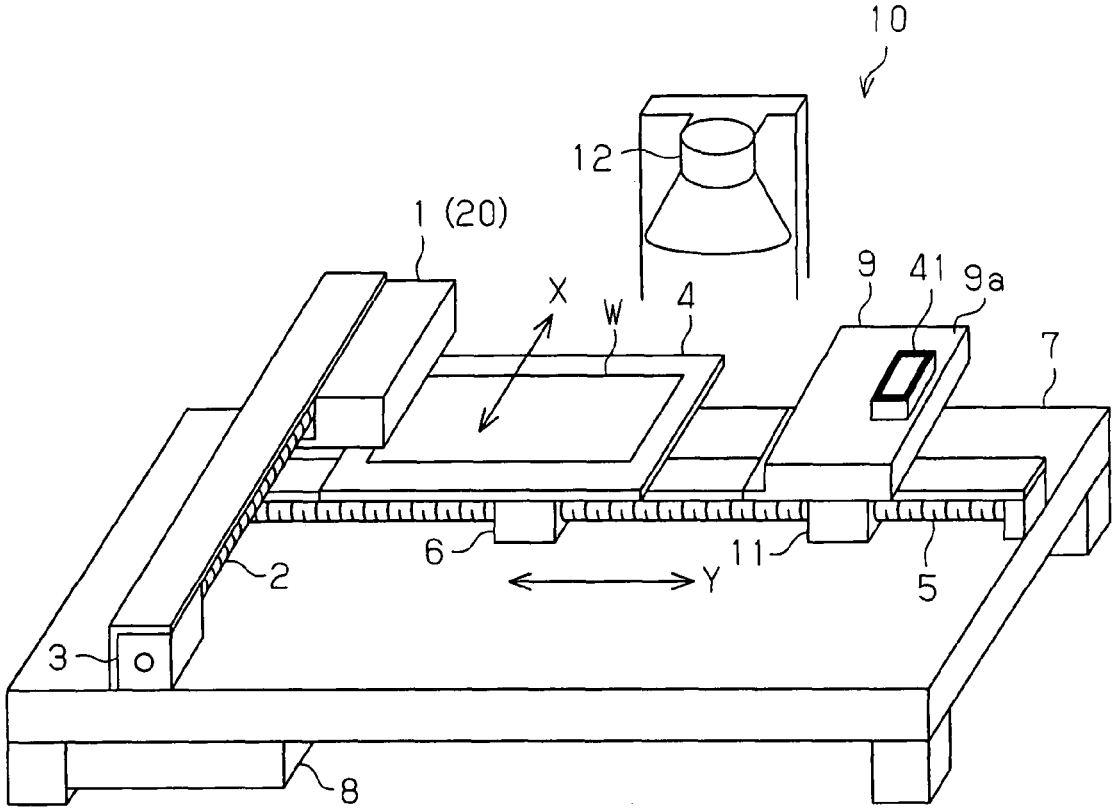
FIG. 1 is a perspective view schematically showing a droplet ejection apparatus according to a first embodiment of the present invention.

Referring to FIG. 1, a droplet ejection apparatus 10 of the illustrated embodiment ejects liquefied material containing functional material onto a workpiece W as droplets. The droplets thus form a film of the functional material on the workpiece W. The droplet ejection apparatus 10 has a stage 4 on which the workpiece W is mounted and a head unit 1 having a droplet ejection head 20 (see FIG. 2).

The droplet ejection apparatus 10 has an X-axis guide shaft 2 and an X-axis drive motor 3. The X-axis guide shaft 2 is driven by the X-axis drive motor 3 to move the head unit 1 in a sub scanning direction, or direction X. The droplet ejection apparatus 10 also includes a Y-axis shaft 5 and a Y-axis drive motor 6. The Y-axis drive motor 6 rotates in a state engaged with the Y-axis shaft 5 to move the stage 4 in a main scanning direction, or direction Y. The X-axis guide shaft 2 and the Y-axis shaft 5 are provided in a base 7. A controller 8 is secured to the lower surface of the base 7. The controller 8 includes a head drive section that drives the head unit 1.

The droplet ejection apparatus 10 includes a maintenance mechanism 9 and a heater 12. The maintenance mechanism 9 performs maintenance of a droplet ejection head 20. The heater 12 heats ejected droplets to evaporate solvent from the droplets. The maintenance mechanism 9 has a maintenance table 9*a*. A Y-axis drive motor 11 is secured to the maintenance table 9*a* and engaged with the Y-axis shaft 5. When powered by the Y-axis drive motor 11, the maintenance mechanism 9 moves along the Y-axis shaft 5. The guide shafts 2, 5 and the drive motors 3, 6, 11 form a movement device.

Figure 2A:
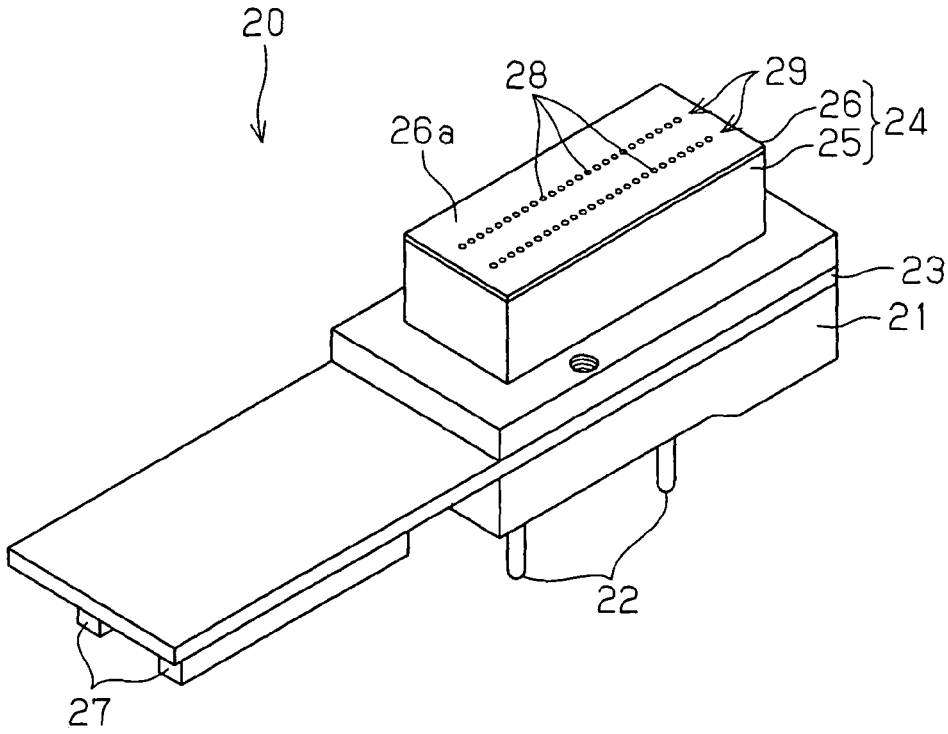
FIG. 2A is a perspective view schematically showing a droplet ejection head of the apparatus of FIG. 1.

With reference to FIG. 2A, the droplet ejection head 20 of the head unit 1 ejects liquefied material from nozzles 28 onto the workpiece W. The droplet ejection head 20 performs such ejection in correspondence with ejection voltage supplied by the controller 8.

The X-axis motor 3 is, for example, a stepping motor but not restricted to this. When the controller 8 provides a drive pulse signal to the X-axis drive motor 3, the X-axis drive motor 3 drives the X-axis guide shaft 2 to rotate. This moves the head unit 1, which is engaged with the X-axis guide shaft 2, along direction X.

Like the X-axis motor 3, the Y-axis motors 6, 11 are, but not restricted to, stepping motors, for example. When the controller 8 sends a drive pulse signal to the Y-axis drive motors 6, 11, the drive motors 6, 11, which are engaged with the Y-axis shaft 5, operate to move the stage 4 and the maintenance table 9*a* in direction Y.

When carrying out maintenance (recovery) of the droplet ejection head 20, the maintenance mechanism 9 (the maintenance table 9*a*) is moved to a position facing the head unit 1. The maintenance mechanism 9 has a cap casing 41, which substantially seals a nozzle forming surface 26*a* (see FIG. 2A) of the droplet ejection head 20 to draw the unnecessary ink from the droplet ejection head 20. The maintenance table 9*a* has a wiping device (not shown) that wipes the nozzle forming surface 26*a* to which the ink is adhered. In preliminary ejection, or flushing, in which the liquefied material is ejected from all of the nozzles 28 of the droplet ejection head 20, the cap casing 41 receives the ejected liquefied material, which is unnecessary, and discharges the liquefied material. The controller 8 controls operation of each of the devices provided in the maintenance mechanism 9.

The heater 12 is a device that performs heat treatment on the workpiece W by, for example, lamp annealing, but not restricted to this. The heater 12 evaporates the solvent from the droplets on the workpiece W to dry the droplets. The heater 12 also carries out heat treatment on the droplets to convert the droplets into a film. The controller 8 controls activation and deactivation of the power source of the heater 12.

When performing ejection of the liquefied material onto the workpiece W with the droplet ejection apparatus 10, the controller 8 provides a prescribed drive pulse signal to the X-axis drive motor 3 and the Y-axis drive motor 6. This moves the head unit 1 in the sub scanning direction and the stage 4 in the main scanning direction. Synchronously with such movement, the controller 8 supplies the ejection voltage to the droplet ejection head 20, thus causing the droplet ejection head 20 to eject the liquefied material onto a predetermined area on the workpiece W as droplets.

The amount of the droplets ejected from the droplet ejection head 20 is adjustable in correspondence with the ejection voltage supplied by the controller 8.

As shown in FIG. 2A, the droplet ejection head 20 has a liquefied material inlet portion 21 having two connection needles 22, a head substrate 23 stacked on the inlet portion 21, and a head body 24 arranged on the head substrate 23. The head body 24 has a liquefied material passage (an in-head passage) defined in the interior of the head body 24. The connection needles 22 are connected to a tank (not shown) in which the liquefied material is retained through piping (not shown). The liquefied material is thus supplied to the in-head passage through the connection needles 22. The head substrate 23 has two connectors 27 connected to the head drive section of the controller 8 through a flexible flat cable (not shown).

The head body 24 includes a pressurizing portion 25 and a nozzle plate 26. A plurality of piezoelectric elements and a plurality of cavities are provided in the pressurizing portion 25. The nozzle plate 26 has a nozzle forming surface 26*a*. Two parallel nozzle rows 29 are defined in the nozzle forming surface 26*a*.

Each of the nozzle rows 29 includes a plurality of, for example, 180, nozzles 28. The nozzles 28 are spaced at substantially equal intervals. The two nozzle rows 29 are arranged offset from each other in the extending direction of each nozzle row 29 by the margin corresponding to a half of the interval between each adjacent pair of the nozzles 28 of the nozzle row 29. Such interval is, for example, 140 μm. Therefore, when viewing the nozzle rows 29 in a direction perpendicular to each nozzle row 29, 360 nozzles 28 are aligned and spaced at the pitch of approximately 70 μm. Nonetheless, since the ejection amount of the ten nozzles 28 located at the opposing ends of each nozzle row 29 is not easily stabilized compared to the rest of the nozzles 28, the ten nozzles 28 at the opposing ends of the nozzle row 29 are not operated in actual ejection of the liquefied material.

When a drive waveform is provided from the head drive section of the controller 8 to the piezoelectric elements as an electric signal, the volumes of the corresponding cavities change. This causes a pumping effect that pressurizes the liquefied material in the cavities, thus ejecting the liquefied material from the nozzles 28 as droplets. Although the droplet ejection head 20 of the illustrated embodiment has the two nozzle rows 29, the droplet ejection head 20 may include a single nozzle row 29. As long as the method by which the droplet ejection head 20 is operated allows ejection of the liquefied material as droplets, the method may be a bubble method by which the liquefied material is pressurized by bubbles produced through heating of the liquefied material by a heat generator or a method using an electrostatic actuator having an electromechanical transducer element.

Figure 2B:
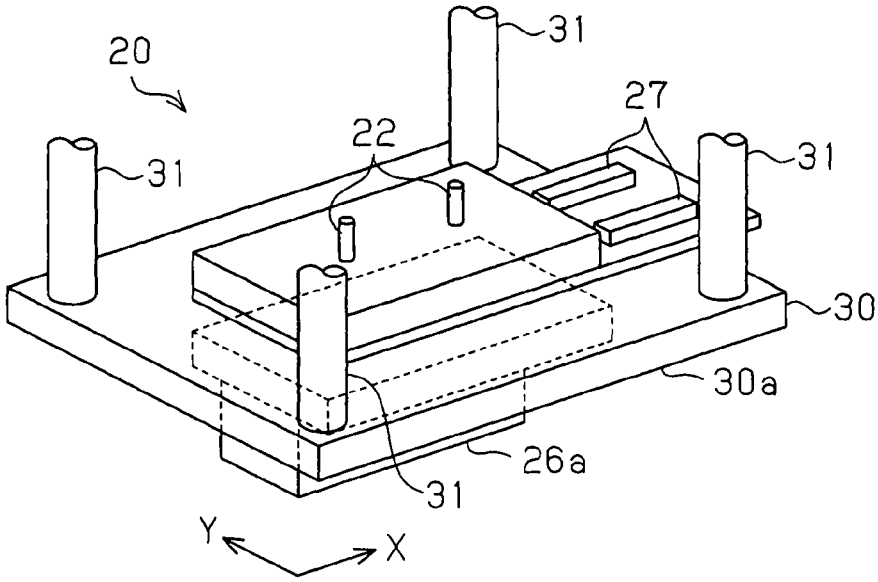
FIG. 2B is a perspective view schematically showing the position of the droplet ejection head of FIG. 2.

As shown in FIG. 2B, the droplet ejection head 20 is supported by a carriage plate 30 formed of stainless steel as a head support portion. The head body 24 projects downward from a surface 30*a* of the carriage plate 30. The carriage plate 30 is secured to the head unit 1 by four support pillars 31 projecting from the four corners of the carriage plate 30 in such a manner that the nozzle forming surface 26*a* extends horizontally. In this state, each of the nozzle rows 29 of the droplet ejection head 20 extends in a direction perpendicular to the main scanning direction (direction Y).

Figure 3A:
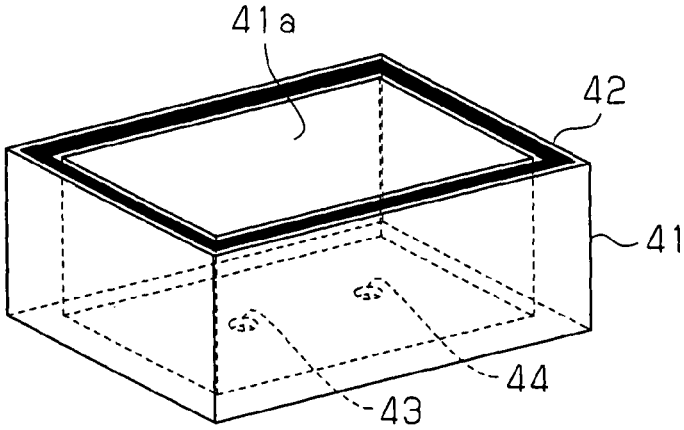
FIG. 3A is a perspective view schematically showing a cap casing.
Figure 3B:
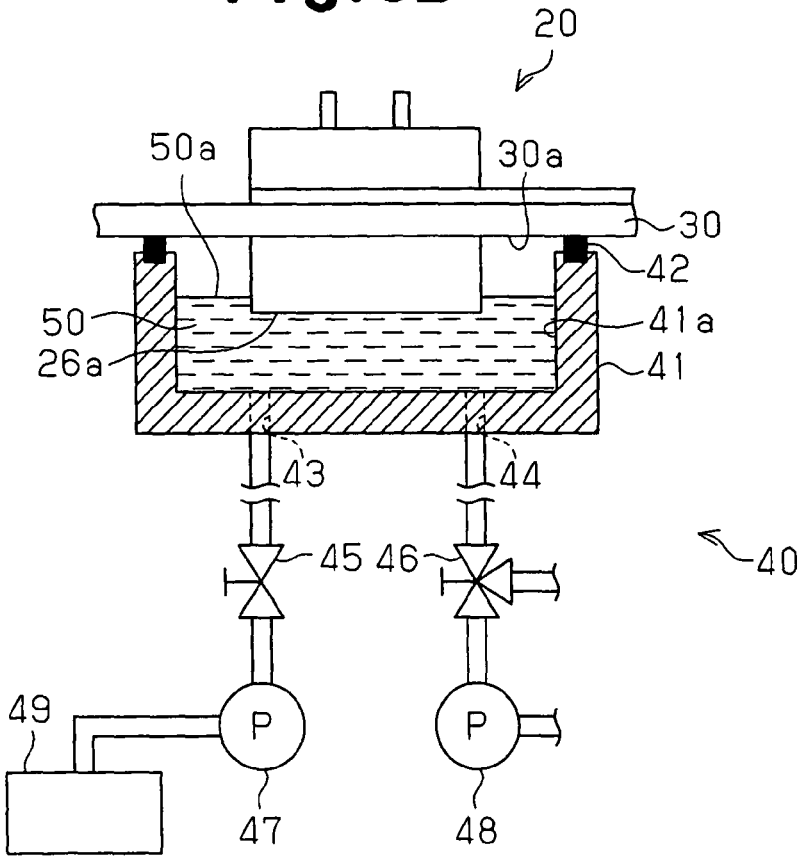
FIG. 3B is a view schematically showing the cap casing and members related to the cap casing.

FIGS. 3A and 3B schematically show a cap mechanism 40 provided on the maintenance table 9*a*. Specifically, FIG. 3A shows the cap casing 41 of the cap mechanism 40, while FIG. 3B shows members related to the cap casing 41.

As shown in FIG. 3A, the cap casing 41 is a box-like body formed of hard material such as stainless steel. An opening is defined in a surface of the cap casing 41. The cap casing 41 has an accommodating portion 41*a* in which a portion of the droplet ejection head 20 that includes at least the nozzle forming surface 26*a* is accommodated. A seal member 42 formed by an elastic member is arranged at the opening end of the cap casing 41. Two holes 43, 44 are formed in the bottom of the accommodating portion 41*a*.

The seal member 42 is formed of solvent resistant elastic material, such as red silicone rubber or fluorine containing rubber. It is desirable that, as the elastic material, a material be selected that exhibits the least volumetric changes due to swelling when immersed in the solvent contained in the liquefied material.

As shown in FIG. 3B, the cap mechanism 40 has the cap casing 41, a pump 47 serving as a liquid supply device, a pump 48 serving as a suction device, and a drive device (not shown) such as a hydraulic cylinder. The drive device drives the cap casing 41 to selectively approach and separate from the surface 30*a* of the carriage plate 30.

The pump 47 is, for example, a bellows type. The pump 47 sends a liquid 50, which is retained in a tank 49, to the accommodating portion 41*a* of the cap casing 41 through pipes, a valve 45, and the hole 43. The liquid 50 is the same type as at least one type of solvent contained in the liquefied material ejected from the ejection head 20.

The pump 48 is, for example, a rotary pump and discharges liquefied material or gas from the accommodating portion 41*a* to the exterior through pipes and a valve 46. The valve 46 is a three-way valve and selectively opens and closes a pipe connected to the pump 48. With the pipe connected to the pump 48 closed, the valve 46 allows exposure of a pipe connected to the hole 44 to the atmospheric air.

The two pumps 47, 48 and the tank 49 are connected to the cap casing 41 through the corresponding pipes that are provided in correspondence with the respective functions of the pumps 47, 48 and the tank 49. The pumps 47, 48 and the tank 49 are arranged in the vicinity of the droplet ejection apparatus 10. The controller 8 controls operation of the two pumps 47, 48 and the two valves 45, 46.

When recovery is performed on the droplet ejection head 20 or the droplet ejection head 20 is in a nonoperating (storage) state, the controller 8 drives the X-axis drive motor 3 and the Y-axis drive motor 11 to send the cap casing 41 to a position opposed to the droplet ejection head 20. The controller 8 then actuates the drive device to raise the cap casing 41 until the seal member 42 of the cap casing 41 contacts the surface 30*a* of the carriage plate 30. This causes the cap casing 41 to substantially seal the nozzle forming surface 26*a*. In this state, the nozzle forming surface 26*a* is immersed in the liquid 50 in the accommodating portion 41*a* of the cap casing 41. If the time in which the droplet ejection head 20 is to be held in the nonoperating state is as short as approximately an hour, the amount of evaporation of the liquid 50 can be ignored. In this case, the nozzle forming surface 26*a* does not have to be completely sealed. In other words, the nozzle forming surface 26*a* may be immersed in the liquid 50 with the cap casing 41 slightly spaced from the carriage plate 30. Contrastingly, if the time in which the droplet ejection head 20 is to be held in the nonoperating state is longer, it is desirable to completely seal the nozzle forming surface 26*a*.

The controller 8 actuates the pump 47 to adjust the amount of the liquid 50 in the accommodating portion 41*a*. In this manner, excessive rising of a liquid surface 50*a* when the droplet ejection head 20 is immersed in the liquid 50 is suppressed. This prevents leakage of the liquid 50 from the cap casing 41 to the exterior and exposure of the seal member 42 to the liquid 50. It is preferable that the liquid surface 50*a* be adjusted to a height that allows the nozzle forming surface 26*a* to be slightly immersed in the liquid 50. The liquid 50 thus enters the interior of the droplet ejection head 20 through the nozzles 28 by the amount corresponding to the difference between the height of the liquid surface 50*a* and the height of the nozzle forming surface 26*a*. This suppresses entering of an excessive amount of the liquid 50 into the interior of the droplet ejection head 20.

Further, the controller 8 performs suction, which is a procedure of recovery of the droplet ejection head 20. Specifically, after the nozzle forming surface 26*a* is immersed in the liquid 50, the controller 8 operates to retract the cap casing 41 slightly from the position of FIG. 3B, thus separating the cap casing 41 from the carriage plate 30. The controller 8 then opens the valve 46 and actuates the pump 48, draining the liquid 50 from the cap casing 41. Afterwards, the controller 8 closes the valve 46 and brings the cap casing 41 into contact with the carriage plate 30, sealing the nozzle forming surface 26*a*. Subsequently, the controller 8 opens the valve 46 and activates the pump 48, lowering the pressure in the accommodating portion 41*a* to a negative level. In this manner, the liquefied material containing the liquid 50, foreign matter, and bubbles are drawn from the interior of the droplet ejection head 20 through the nozzles 28. After continuing such suction for a predetermined time or until a predetermined amount of the liquefied material is discharged, the controller 8 deactivates the pump 48 and opens the valve 46 to an exposure-to-atmospheric-air position. The cap casing 41 is then separated from the carriage plate 30. Through such suction, the meniscus in the nozzles 28 of the droplet ejection head 20 is normalized. More details of the method for recovering the droplet ejection head 20 will be described later.

The first embodiment has the following advantages.

(1) In the first embodiment, the droplet ejection apparatus 10 has the cap mechanism 40 including the cap casing 41, which retains the liquid 50 formed by at least one type of solvent contained in the liquefied material. When the droplet ejection head 20 is subjected to recovery or held in a storage state, the nozzle forming surface 26*a* of the droplet ejection head 20 is immersed in the liquid 50 in the cap casing 41. This prevents exposure of the nozzle forming surface 26*a* to the air, allowing foreign matter, which is the liquefied material dried in the nozzles 28 or the nozzle forming surface 26*a*, to be dissolved or dispersed in the liquid 50. Therefore, clogging of the nozzles 28 or offset traveling of the ejected liquefied material, which are caused by the foreign matter adhered to the nozzle forming surface 26*a*, are suppressed.

(2) The controller 8 substantially seals the nozzle forming surface 26*a* by causing contact between the seal member 42 of the cap casing 41 and the surface 30*a* of the carriage plate 30. The controller 8 then activates the pump 48 to generate negative pressure in the accommodating portion 41*a*, which is maintained in a sealed state, to perform suction, or draw the liquefied material, the foreign matter, and bubbles from the interior of the droplet ejection head 20 through the nozzles 28. This normalizes the meniscus of the liquid in the nozzles 28. Further, since the cap casing 41 does not directly contact the nozzle forming surface 26*a*, transfer of the foreign matter from the cap casing 41 to the nozzle forming surface 26*a* is prevented. The nozzle forming surface 26*a* is thus maintained in a clean state.

(3) The seal member 42 of the cap casing 41 is formed of the solvent resistant elastic material. Therefore, even if the liquid 50 adheres to the seal member 42, the seal member 42 does not easily deteriorate. This ensures long-term air-tightness of the droplet ejection head 20 when the droplet ejection head 20 is sealed by the cap casing 41.

Figure 4A:
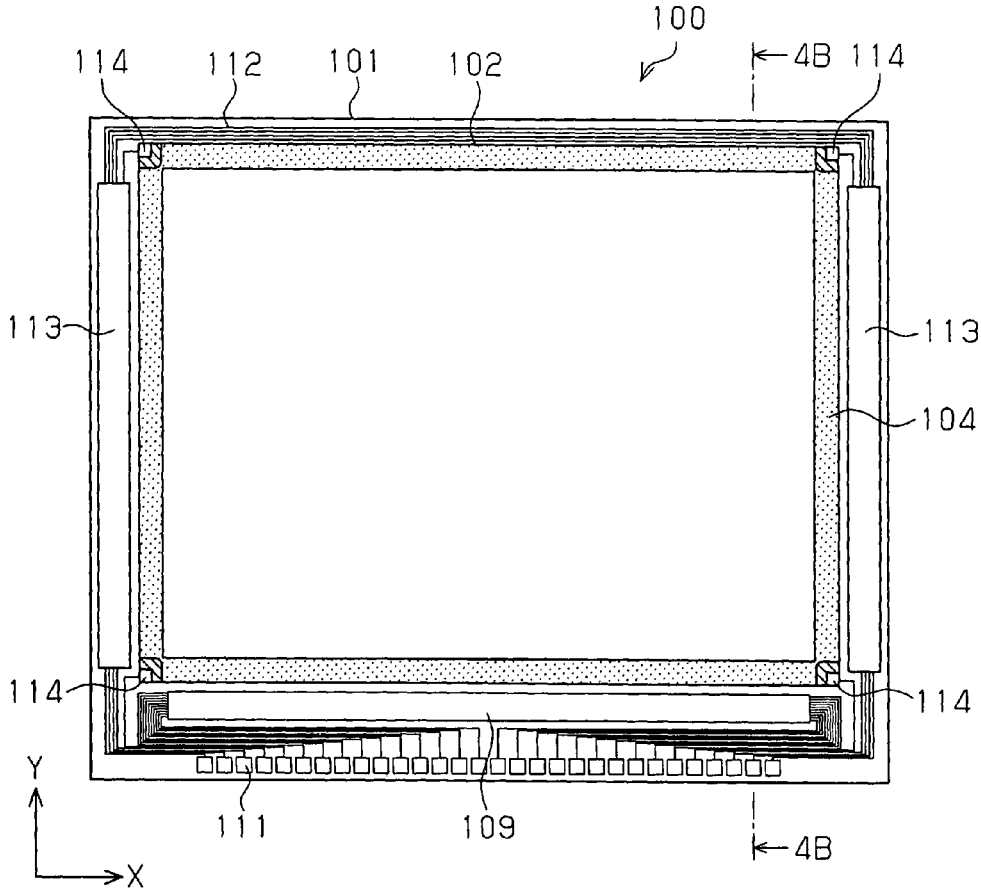
FIG. 4A is a front view showing a liquid crystal display according to a second embodiment of the present invention.

A second embodiment of the present invention will hereafter be explained with reference to FIGS. 4A and 4B. In the following, by way of example, a method for forming an alignment film of a liquid crystal display, which is an electro-optic device, will be explained. In the second embodiment, the droplet ejection apparatus 10 of the first embodiment will be used as an alignment film forming apparatus. FIG. 4A is a front view showing a liquid crystal display 100, and FIG. 4B is a cross-sectional view taken along line 4B-4B of FIG. 4A.

Figure 4B:
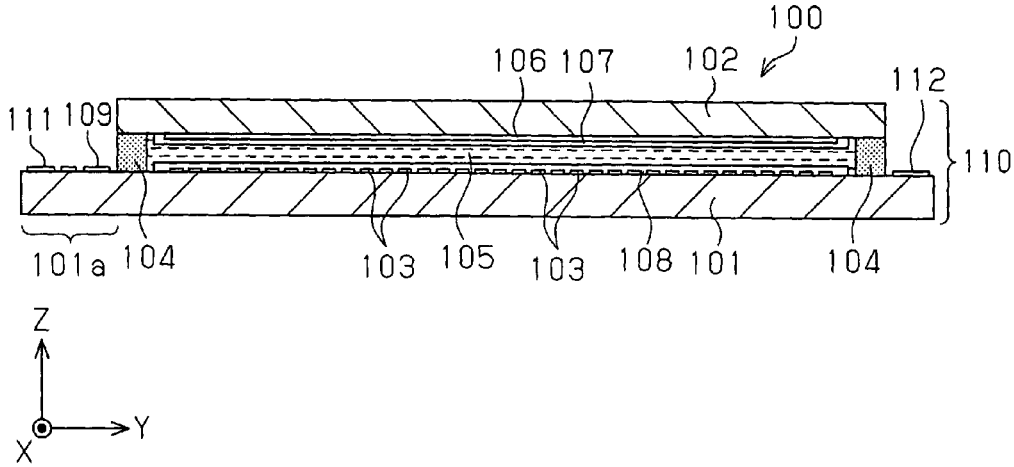
FIG. 4B is a cross-sectional view taken along line 4B-4B of FIG. 4A.

As shown in FIGS. 4A and 4B, the liquid crystal display 100 includes a liquid crystal display panel 110 including an element substrate 101, an opposed substrate 102, and liquid crystal 105. The element substrate 101 has a number of TFT (Thin Film Transistor) elements 103. The opposed substrate 102 has an opposed electrode 106. The two substrates 101, 102 are bonded together by a seal material 104. The clearance between the substrates 101, 102 is filled with the liquid crystal 105. The element substrate 101 is larger than the opposed substrate 102, projecting from the circumference of the opposed substrate 102. As the seal material 104, an epoxy type adhesive is used. The adhesive hardens when exposed to heat or light such as ultraviolet rays.

The element substrate 101 is formed by a quartz glass substrate having thickness of approximately 1.2 mm. A plurality of pixel electrodes (not shown) and a plurality of TFT elements 103 are formed on a surface of the element substrate 101. Each of the TFT elements 103 has three terminals, with one of the three terminals connected to the corresponding one of the pixel electrodes. One of the remaining two terminals of each TFT element 103 is connected to the corresponding one of data lines (not shown), while the other is connected to the corresponding one of scanning lines (not shown). The data lines and the scanning lines are arranged in a grid-like shape in such a manner as to encompass the pixel electrodes. The data lines and the scanning lines are mutually insulated. Each of the data lines is routed along direction Y and connected to a data line driver circuit portion 109 at a terminal portion 101*a*, which is formed at one side of the element substrate 101. Each of the scanning lines is routed along direction X and connected to two scanning line driver circuit portions 113, 113, which are formed at opposing, left and right, sides of the element substrate 101. A plurality of input lines of the data line driver circuit portion 109 and each of the scanning line driver circuit portions 113 are connected to corresponding mounting terminals 111, which are aligned along the terminal portion 101*a*. At the side of the element substrate 101 opposed to the terminal portion 101*a*, a cable 112 connects the scanning line driver circuit portions 113 to each other.

The opposed substrate 102 is formed by a transparent glass substrate having thickness of approximately 1.0 mm. The opposed electrode 106 is provided on the opposed substrate 102 as a common electrode. The opposed electrode 106 is connected with cables provided in the element substrate 101 through conducting portions 114, which are arranged at the four corners of the opposed substrate 102. The cables are connected to the mounting terminals 111.

A thin film formed of polyimide or the like, or an alignment film 108, is formed on the surface of the element substrate 101 facing the liquid crystal 105. A thin film formed of polyimide or the like, or an alignment film 107, is formed on the surface of the opposed substrate 102 facing the liquid crystal 105.

Although not particularly illustrated, the liquid crystal display 100 includes a relay substrate, which is electrically connected to an external driver circuit. The relay substrate is connected to the mounting terminals 111. In response to signals of the external driver circuit, which are provided to the data line driver circuit portion 109 and the scanning line driver circuit portions 113, the TFT elements are switched in correspondence with the pixel electrodes. This supplies drive voltage between the pixel electrodes and the opposed electrodes 106, thus displaying an image.

Although not illustrated either, the liquid crystal display 100 has an illumination device (not shown) that illuminates the liquid crystal display panel 110 and has a light source such as a cold cathode tube or an LED. Polarizing plates are provided at a light incident surface and a light exit surface of the liquid crystal display panel 110 with respect to the illumination device. The liquid crystal display 100 may be what is called an active type having TFD (Thin Film Diode) elements as switching elements. Alternatively, the liquid crystal display 100 may be a passive type without switching elements.

A method for forming the alignment films 107, 108 will be described with reference to FIGS. 5A to 5D.

The method includes a surface treatment step, an ejection step, a drying step, and a baking step. In the surface treatment step, a lyophilic property is provided to the surface of a workpiece W on which an alignment film is to be formed. In the ejection step, liquefied material containing alignment film forming material is ejected onto the workpiece W using the droplet ejection apparatus 10. In the drying step, the ejected liquefied material is dried. In the baking step, the dried liquefied material is baked and fixed on the workpiece W as the alignment film. The ejection step includes a step of performing recovery of the droplet ejection head 20 for ensuring stable ejection of the liquefied material. The workpiece W may be the element substrate 101 in which the pixel electrodes and the TFT elements 103 are provided or the opposed substrate 102 on which the opposed electrode 106 is formed.

Figure 5A:
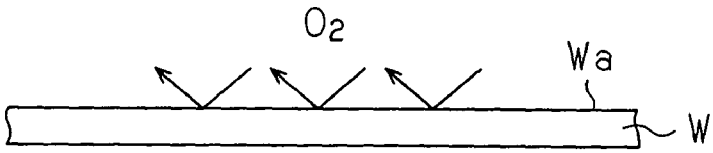
FIGS. 5A, 5B, 5C, and 5D are views schematically illustrating a method for forming an alignment film.

As illustrated in FIG. 5A, a plasma treatment using oxygen ($O_2$) as a treatment gas is carried out in the surface treatment step. This provides a lyophilic property to a surface Wa of the workpiece W. The surface treatment is not restricted to the plasma treatment but may be a method in which ultraviolet rays are radiated onto the surface Wa of the workpiece W. Further, before the surface treatment step for providing the lyophilic property to the surface Wa, it is desirable that the workpiece W be cleansed with pure water to remove foreign matter or contaminants from the surface.

Figure 5B:
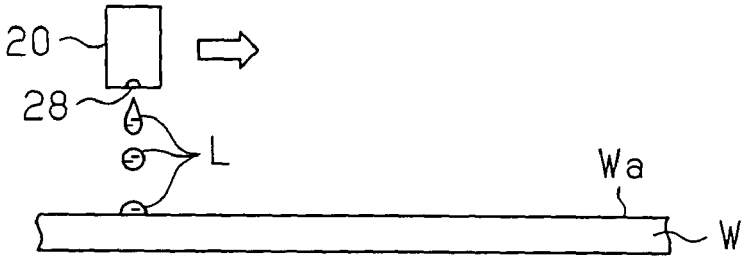
Figure 5C:
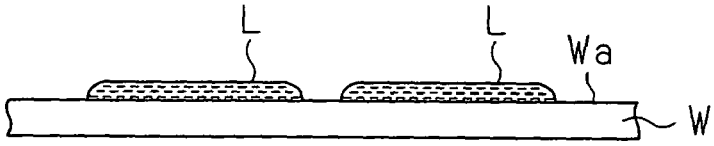

Subsequently, in the ejection step, the surface Wa of the workpiece W, which has become lyophilic, and the droplet ejection head 20 are moved relative with each other while being mutually opposed as illustrated in FIG. 5B. In other words, main scanning and sub scanning are performed. In the main scanning, liquefied material L containing alignment film forming material is ejected from the nozzles 28 of the droplet ejection head 20 as droplets. The liquefied material L is thus applied onto a predetermined area of the workpiece W, as illustrated in FIG. 5C. The liquefied material L contains 1 to 3 weight percent of polyimide as the alignment film forming material, γ butyrolactone as main solvent, and NMP and butyl cellosolve as additional solvents.

Next, in the drying step, the liquefied material L is dried on the workpiece W. Such drying is accomplished by heating the liquefied material L using the heater 12 of the droplet ejection apparatus 10, thus evaporating the solvent from the liquefied material L.

Figure 5D:
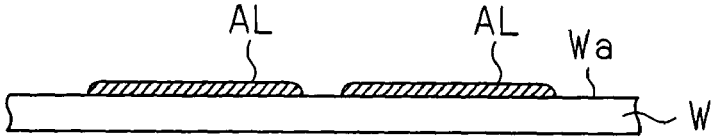

Further, in the baking step, the workpiece W is placed and maintained in, for example, a clean oven heated to approximately 180 to 200° C. for approximately an hour. The dried liquefied material L is thus baked. As a result, as illustrated in FIG. 5D, a fixed alignment film AL is formed on the surface Wa. The thickness of the alignment film AL is approximately 20 nm to 50 nm.

In the following, a method for recovering the droplet ejection head 20 in the ejection step will be described with reference to FIGS. 6 and 7A to 7D.

Figure 6:
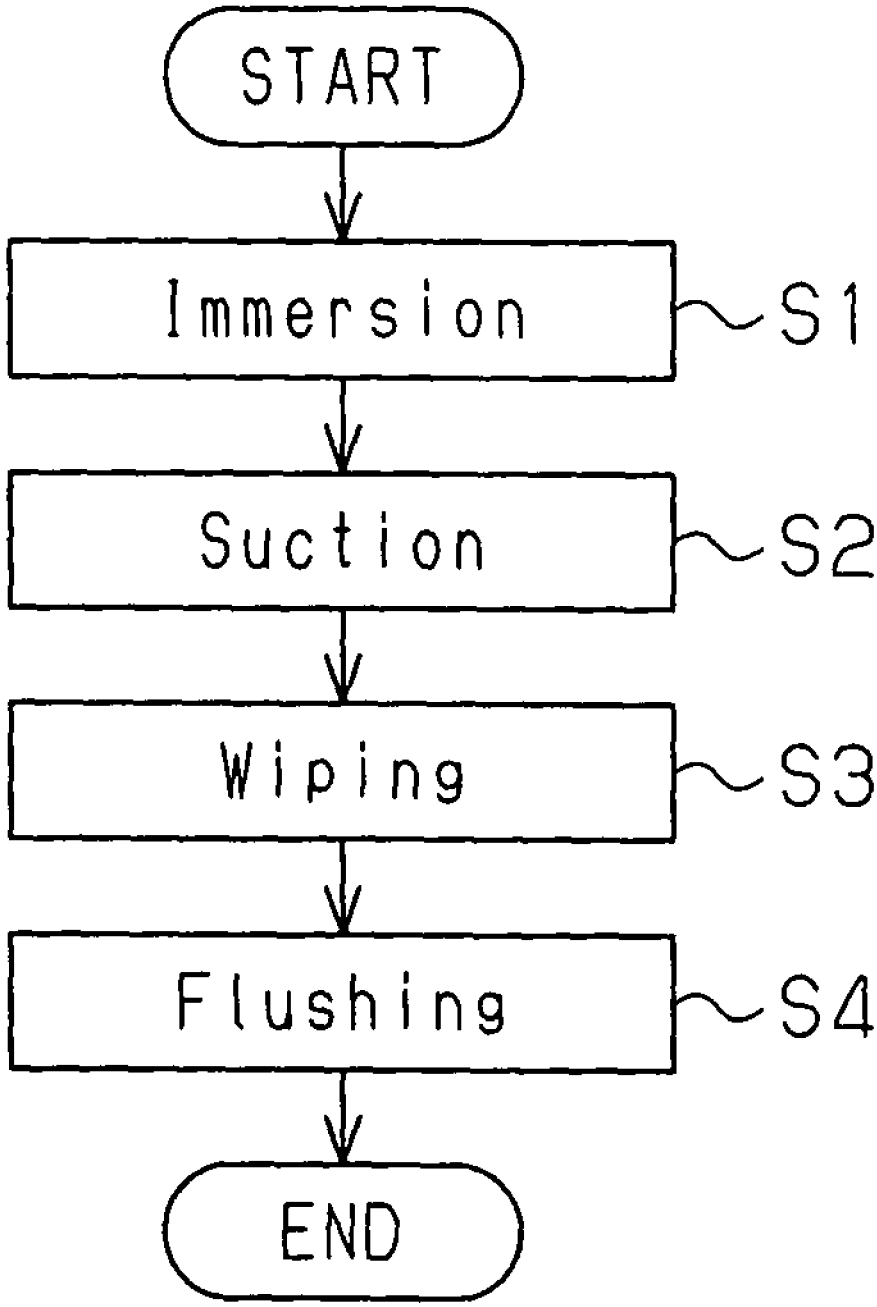
FIG. 6 is a flowchart representing a method for recovering a droplet ejection head.

With reference to FIG. 6, the method for recovering the droplet ejection head 20 includes an immersion step (step 1), a suction step (step S2), a wiping step (step S3), and a flushing step (step S4). In step S1, the nozzle forming surface 26*a* is immersed in the liquid 50. In step S2, the nozzle forming surface 26*a* is substantially sealed and subjected to suction. In step S3, the liquefied material L, which has adhered to the nozzle forming surface 26*a* through suction, is removed from the nozzle forming surface 26*a*. In step S4, preliminary ejection is performed for ejecting the liquefied material L from all of the nozzles 28.

In the immersion step, or step S1, the controller 8 activates the pump 47 to supply a predetermined amount of liquid 50 to the accommodating portion 41*a* of the cap casing 41. Subsequently, the controller 8 moves the head unit 1 and the maintenance mechanism 9 until the cap casing 41 is arranged at the position opposed to the droplet ejection head 20. Then, the controller 8 drives the drive device to raise the cap casing 41 until the seal member 42 contacts the surface 30*a* of the carriage plate 30. In this manner, the nozzle forming surface 26*a* is immersed in the liquid 50. In this state, since the liquid 50 has been supplied to the accommodating portion 41*a* by the predetermined amount, the liquid surface 50*a* is located at a position slightly higher than the nozzle forming surface 26*a*. The nozzle forming surface 26*a* is maintained in the immersed state for at least several minutes. The liquid 50 is γ butyllactone, which is one of the several types of solvents contained in the liquefied material L. The liquid 50 is thus soluble with respect to the polyimide, or the alignment film forming material.

Figure 7A:
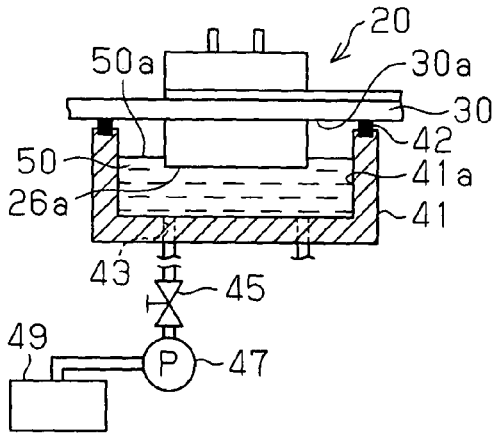
FIGS. 7A, 7B, 7C, and 7D are cross-sectional views schematically illustrating the method for recovering the droplet ejection head.
Figure 7B:
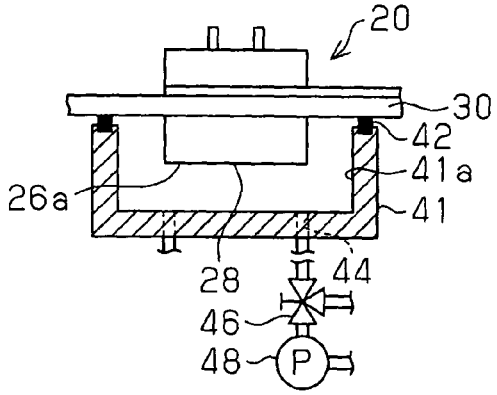

As illustrated in FIG. 7B, in the suction step, or step S2, the cap casing 41 is held in contact with the carriage plate 30, substantially sealing the nozzle forming surface 26*a*. By this time, the liquid 50 has been drained from the accommodating portion 41*a*. The controller 8 actuates the pump 48 to cause negative pressure in the accommodating portion 41*a*, which is held in a sealed state. This draws the liquefied material L containing the liquid 50, foreign matter, and bubbles from the interior of the droplet ejection head 20. The liquefied material L and the liquid 50 are then discharged from the cap casing 41 by the pump 48.

Figure 7C:
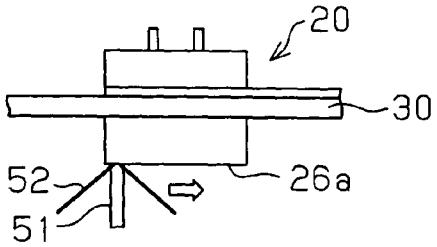

Referring to FIG. 7C, in the wiping step, or step S3, the controller 8 actuates the wiping device provided in the maintenance mechanism 9. The wiping device includes, for example, a wiping sheet 52, which is formed of 100% polyester and has thickness of approximately 0.5 mm, as a wiping member. A pressing member 51 presses the wiping sheet 52 against the nozzle forming surface 26*a*. In this state, the wiping sheet 52 is moved along the nozzle forming surface 26*a* to remove the liquefied material L and the foreign matter from the nozzle forming surface 26*a*. Such wiping may be repeatedly performed while changing portions of the wiping sheet 52 that are pressed against the nozzle forming surface 26*a*.

Figure 7D:
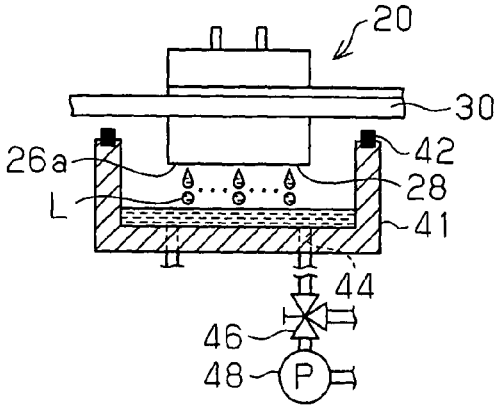

As illustrated in FIG. 7D, in the flushing step, or step S4, the controller 8 moves the maintenance mechanism 9 until the cap casing 41 is arranged at the position opposed to the droplet ejection head 20. All of the nozzles 28 of the droplet ejection head 20 are then caused to eject the liquefied material L as droplets. The ejection cycle is repeated for 200 to 300 times. The ejected liquefied material L is received by the cap casing 41 and drained to the exterior by the pump 48. Such flushing, or preliminary ejection, may be performed with the cap casing 41 functioning as a receptacle. Alternatively, a receptacle may be provided at an end of the stage 4 specifically for flushing. In this case, using the receptacle, flushing is carried out immediately before the liquefied material L is ejected onto the workpiece W. Further, a weight measuring portion, for example, may be arranged in the maintenance mechanism 9 and used as a receptacle when ejection is performed. In this case, by measuring the weight of the liquefied material L ejected in a predetermined number of ejection cycles, it is determined whether all of the nozzles 28 have performed normal ejection of the liquefied material L.

In the immersion step (step S1) of the above-described method for recovering the droplet ejection head 20, the foreign matter formed by the liquefied material L dried in the nozzles 28 or on the nozzle forming surface 26*a* is dissolved in the liquid 50 without exposing the nozzle forming surface 26*a* to air. In the suction step (step S2), the liquefied material L, the foreign matter, and the bubbles are drawn from the droplet ejection head 20 through the nozzles 28. In the wiping step (step S3), the remaining liquefied material L is removed from the nozzle forming surface 26*a*. In the flushing step (step S4), the preliminary ejection is carried out before main ejection so as to stabilize ejection of the liquefied material L from the nozzles 28. That is, a normal state of the droplet ejection head 20 is restored.

It is preferred that such recovery of the droplet ejection head 20 be accomplished before main ejection. Also, the recovery may be performed after an examination step. In the examination step, preliminary ejection is periodically performed. In this manner, through weight measurement, it is determined whether normal ejection of the liquefied material is being carried out, and the droplet ejection is monitored to ensure that offset traveling is not happening. Further, if the droplet ejection head 20 needs to be stored in a nonoperating state for a long time, the droplet ejection head 20 is stored in a state corresponding to the immersion step (step S1).

The second embodiment has the following advantages.

(1) The method for recovering the droplet ejection head 20 includes the immersion step (step S1), the suction step (step S2), the wiping step (step S3), and the flushing step (step S4). Through these steps, the dried liquefied material L, which causes clogging of the nozzles 28 and offset traveling of the liquefied material L, is dissolved in the liquid 50. Further, the liquefied material L, the foreign matter, and the bubbles are drawn and discharged from the interior of the droplet ejection head 20 through the nozzles 28. Also, the liquefied material L unnecessarily adhered to the nozzle forming surface 26*a* is removed by the wiping sheet 52. In other words, the nozzle forming surface 26*a* is maintained in a clean state, while the meniscus in the nozzles 28 is maintained normal.

(2) If the droplet ejection head 20 needs to be stored in a nonoperating state for a long time, the droplet ejection head 20 is stored in a state corresponding to the immersion step (step S1). This prevents the nozzle forming surface 26*a* from being exposed to the air for a long time and thus becoming dry. Therefore, the droplet ejection head 20 is reliably stored without causing problems such as clogging of the nozzles 28, till subsequent use of the droplet ejection head 20.

(3) In the ejection step, the droplet ejection head 20 is recovered. Such recovery is performed before main ejection by the droplet ejection head 20, or periodically. This maintains stable ejection by suppressing clogging of the nozzles 28 and offset traveling of the liquefied material L. A further uniform alignment film is thus formed on the workpiece W. As a result, the liquid crystal display 100 with improved display quality is provided.

The illustrated embodiments of the present invention, which have been described so far, may be modified in the following various forms.

Figure 8:
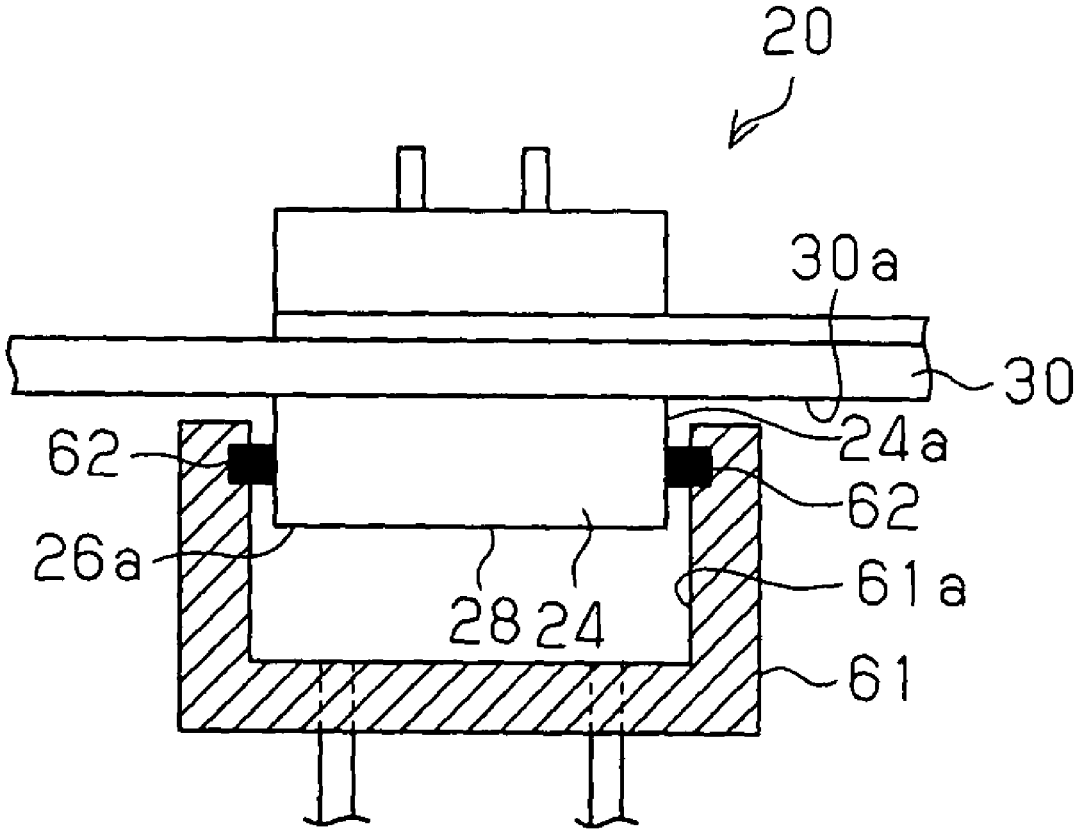
FIG. 8 is a cross-sectional view schematically showing a cap casing of a modified example.

The cap casing 41 of the first embodiment is not restricted to the above-described configuration. FIG. 8 shows a modified example of the cap casing, or a cap casing 61. For example, the cap casing 61 may have a seal member 62 provided on an inner side surface of an accommodating portion 61*a*. This structure allows tight contact between the seal member 62 and a side surface 24*a* of the head body 24, when the droplet ejection head 20 is accommodated in the accommodating portion 61*a*. The nozzle forming surface 26*a* is thus substantially sealed. In this case, the surface 30*a* of the carriage plate 30, which supports the droplet ejection head 20, does not necessarily have to be flat. That is, the support structure for the droplet ejection head 20 may be designed with increased flexibility.

The droplet ejection apparatus 10 of the first embodiment is not restricted to the structure in which the single droplet ejection head 20 is secured to the head unit 1. However, a plurality of droplet ejection heads 20 may be arranged on the carriage plate 30 and spaced at appropriate intervals. In this case, a plurality of cap casings 41 are provided in the droplet ejection apparatus 10 in correspondence with the droplet ejection heads 20.

The configuration of the cap mechanism 40 of the first embodiment is not restricted to that of the embodiment. For example, a cap casing for storage may be provided separately from the cap casing 41 for immersing the nozzle forming surface 26*a* of the droplet ejection head 20 in the liquid 50.

Although the cap casing 41 and the seal member 42 are provided as separate bodies in the first embodiment, the cap casing 41 and the seal member 42 may be formed of the same material as an integral body.

The method for recovering the droplet ejection head 20 is not restricted to the above-described method. For example, in the wiping step, the wiping sheet 52 may be pressed against the entire portion of the nozzle forming surface 26*a*. Alternatively, the wiping sheet 52 may be impregnated with solvent in advance. Further, the method for recovering the droplet ejection head 20 may start from the suction step, depending on the state of the droplet ejection head 20.

The method for forming the alignment film is not restricted to the above-described method. For example, the surface treatment step may be omitted by cleansing the workpiece W in advance. Alternatively, the drying step and the baking step may be carried out as a common step, instead of being performed as separate steps. The common step is carried out by, for example, maintaining the workpiece W in a chamber including a heating device such as a heater at a predetermined temperature for a predetermined time, thus drying and baking the workpiece W at the same time.

The method for forming the thin film is not restricted to the method for forming the alignment film. For example, by using color element forming material as functional material, the method of the present invention is applicable to a method for forming a color filter as a thin film. Likewise, by selecting functional material as needed, the method is applicable to a method for forming an organic EL light emitting layer, a method for forming a metal thin film of an electric circuit or the like, and a method for forming a micro lens.

The invention claimed is:

1. A droplet ejection apparatus comprising:

a droplet ejection head having a nozzle forming surface in which a nozzle is formed, the droplet ejection head ejecting a liquefied material containing a functional material from the nozzle as a droplet;

a head support portion supporting the droplet ejection head;

a cap casing having an accommodating portion in which a portion of the droplet ejection head including at least the nozzle forming surface is accommodated, wherein the cap casing has a seal member that contacts the head support portion or the droplet ejection head to substantially seal the nozzle forming surface;

a liquid supply device that supplies a liquid to the accommodating portion;

a controller that drives the liquid supply device so as to control the amount of the liquid retained in the accommodating portion; and a movement device that moves at least one of the cap casing and the droplet ejection head relative with the other, wherein, when recovery is performed on the droplet ejection head or the droplet ejection head is held in a nonoperating state, the movement device arranges the cap casing relative to the droplet ejection head in such a manner that the nozzle forming surface is immersed in the liquid retained in the accommodating portion, wherein the controller controls, depending on whether the nozzle forming surface is substantially sealed by the cap casing, the amount of the liquid retained in the accommodating portion such that the liquid does not contact with the seal member.

2. The apparatus according to claim 1, wherein the liquid is at least one type of solvent contained in the liquefied material.

3. The apparatus according to claim 1, wherein the head support portion has a flat surface, the head support portion supporting the droplet ejection head in such a manner that the nozzle forming surface projects from the surface and extends substantially horizontal, wherein the seal member contacts the surface of the head support portion or a side surface of the droplet ejection head for substantially sealing the nozzle forming surface.

4. The apparatus according to claim 3, further comprising a suction device connected to the accommodating portion, wherein, with the nozzle forming surface sealed by the cap casing, the suction device is activated to lower the pressure in the accommodating portion to a negative level.

5. The apparatus according to claim 4, wherein the seal member is a solvent resistant elastic member arranged at a position at which the cap casing contacts the surface of the head support portion or the side surface of the droplet ejection head.

6. The apparatus according to claim 1, wherein the liquefied material containing the functional material is a liquefied material containing an alignment film forming material, and wherein the droplet ejection apparatus is an alignment film forming apparatus that ejects the liquefied material containing the alignment film forming material onto a workpiece as droplets for forming an alignment film on the workpiece.

7. A liquid crystal display having an alignment film formed by the droplet ejection apparatus according to claim 6.

8. A method for recovering a droplet ejection head that ejects a liquefied material containing a functional material from a nozzle as a droplet, the method comprising:

retaining a liquid that is the same as at least one type of solvent contained in the liquefied material in an accommodating portion of a cap casing;

immersing a nozzle forming surface in the liquid in the accommodating portion by receiving a portion of the droplet ejection head including at least the nozzle forming surface in the accommodating portion;

substantially sealing the nozzle forming surface by contacting a seal member arranged on the cap casing to the droplet eiection head or a head support portion, which supports the drop ejection head; and controlling, depending on whether the nozzle forminq surface is substantially sealed by the cap casing, the amount of the liquid retained in the accommodating portion such that the liquid does not contact with the seal member.

9. The method according to claim 8, further comprising:

substantially sealing the nozzle forming surface by the cap casing after immersing the nozzle forming surface in the liquid in the accommodating portion; and drawing the liquefied material from the interior of the droplet ejection head through the nozzle with the nozzle forming surface sealed by the cap casing.

10. The method according to claim 8, wherein the liquefied material containing the functional material is a liquefied material containing an alignment film forming material.

11. A method for forming a thin film of a functional material on a workpiece using a droplet ejection head that ejects a liquefied material containing the functional material from nozzles as droplets, the method comprising:

retaining a liquid that is the same as at least one type of solvent contained in the liquefied material in an accommodating portion of a cap casing;

immersing a nozzle forming surface in the liquid in the accommodating portion by receiving a portion of the droplet ejection head including at least the nozzle forming surface in the accommodating portion;

after the immersing, substantially sealing the nozzle forming surface by contacting a seal member arranged on the cap casing to the droplet election head or a head support portion, which supports the drop ejection head;

controlling, depending on whether the nozzle forming surface is substantially sealed by the cap casing, the amount of the liquid retained in the accommodating portion such that the liquid does not contact with the seal member;

drawing the liquefied material from the interior of the droplet ejection head through the nozzle with the nozzle forming surface sealed by the cap casing;

ejecting the liquefied material as droplets onto the workpiece from the nozzles after the drawing the liquefied material;

drying the droplets on the workpiece, thereby forming a thin film made of the functional material on the workpiece.

12. The method according to claim 11, wherein, to form an alignment film of an alignment film forming material on the workpiece, the liquefied material containing the alignment film forming material is ejected onto the workpiece as the liquefied material containing the functional material.

* * * * *